US009419353B1

(12) United States Patent
Al-Saqabi

(10) Patent No.: US 9,419,353 B1
(45) Date of Patent: Aug. 16, 2016

(54) ELECTRICAL WIRE CONNECTION STRIP

(71) Applicant: Daoud S. Al-Saqabi, Safat (KW)

(72) Inventor: Daoud S. Al-Saqabi, Safat (KW)

( * ) Notice: Subject to any disclaimer, the term of this patent is extended or adjusted under 35 U.S.C. 154(b) by 0 days.

(21) Appl. No.: 15/054,062

(22) Filed: Feb. 25, 2016

(51) Int. Cl.
*H01R 9/22* (2006.01)
*H01R 9/24* (2006.01)

(52) U.S. Cl.
CPC ..... *H01R 9/2416* (2013.01)

(58) Field of Classification Search
CPC ..... H01R 13/26; H01R 13/514; H01R 4/363; H01R 9/24; H01R 31/02
USPC ..... 439/712, 709, 715, 716, 717, 929, 374
See application file for complete search history.

(56) References Cited

U.S. PATENT DOCUMENTS 2,526,255 A * 10/1950 Milbank ..... G01R 1/20 174/138 F
2,727,220 A * 12/1955 Buchanan ..... H01R 4/363 248/500
2,877,440 A * 3/1959 Dorjee ..... H01R 4/363 439/712
3,005,180 A * 10/1961 Dreher ..... H01R 13/42 439/714
3,042,896 A * 7/1962 Doktor ..... H01R 4/26 439/712
3,210,716 A * 10/1965 Meacham ..... H02B 1/21 174/171
3,245,029 A * 4/1966 Piperato ..... H01R 9/26 439/716
3,551,876 A * 12/1970 Walter ..... H01R 9/2675 439/110
3,638,172 A * 1/1972 Adam ..... H01R 4/36 403/391
3,727,171 A * 4/1973 Coles ..... H01R 25/142 439/110
4,040,711 A * 8/1977 Waddington ..... H01R 4/36 439/717
4,516,189 A * 5/1985 Seaks, Jr. ..... H05K 7/16 361/730
4,778,412 A 10/1988 Walter et al.
5,021,014 A * 6/1991 Walter ..... H01R 4/366 439/798
5,595,505 A * 1/1997 Duke ..... H01R 4/34 439/630
5,713,766 A * 2/1998 Davies ..... H01R 9/2491 439/709
5,800,187 A * 9/1998 Vermon ..... H01R 31/085 439/716
6,971,926 B1 12/2005 Walton
7,011,551 B2 * 3/2006 Johansen ..... H01R 9/2641 439/709
7,144,279 B2 * 12/2006 Zahnen ..... H01R 4/36 439/709
7,234,961 B2 * 6/2007 Arlitt ..... H01R 4/24 439/212
7,364,476 B2 * 4/2008 Mueller ..... H01R 4/36 439/709
7,413,487 B1 * 8/2008 Chen ..... H01R 4/36 439/709
7,491,084 B2 * 2/2009 Wedler ..... H01R 9/03 439/404
7,559,810 B1 * 7/2009 Wu ..... H01R 4/34 439/709
7,607,955 B2 * 10/2009 Hill ..... H01R 11/07 439/798
7,942,706 B1 * 5/2011 McSweyn ..... H01R 9/2483 439/709
8,105,118 B2 * 1/2012 Claprood, Jr. ..... H01R 4/304 439/709
8,289,680 B2 * 10/2012 Keegan ..... H05K 7/1432 174/117 R
8,727,818 B2 5/2014 Kossak
8,784,142 B2 7/2014 Golen
9,004,956 B2 * 4/2015 Wu ..... H01R 4/34 439/709
9,093,761 B1 * 7/2015 Wu ..... H01R 4/42
2003/0194917 A1 10/2003 Mullen
2005/0142925 A1 * 6/2005 Mugnaini ..... H01R 4/2491 439/411
2014/0248808 A1 9/2014 Niehoerster

OTHER PUBLICATIONS

"ABB Control 035621021," Standard Electric Supply Co. website.

* cited by examiner

*Primary Examiner* — Abdullah Riyami
*Assistant Examiner* — Vladimir Imas
(74) *Attorney, Agent, or Firm* — Richard C. Litman

(57) ABSTRACT

The electrical wire connection strip includes a bottom housing portion and an upper housing portion that are slidably connected to one another. The electrical wire connection strip is connectable to additional electrical wire connection strips to form a segmented electrical wire connection block or strip, where each segment can be designated to accept a certain wire gauge size.

7 Claims, 8 Drawing Sheets

ELECTRICAL WIRE CONNECTION STRIP

BACKGROUND OF THE INVENTION

1. Field of the Invention

The present invention relates to the field of electric power distribution, and particularly to an electrical wire connection block which enables quick connection of power distribution cables.

2. Description of the Related Art

Transformers are key components presently in electric power distribution networks. Generally, electric power is distributed from electrical substations at high voltage typically in excess of 6,000 volts to minimize losses. Transformers are required to reduce the voltage down to lower levels, such as 120 volts, for local distribution to commercial and residential customers.

A transformer commonly used for this purpose is housed in a steel cabinet on a concrete platform or pad at ground level. The transformer itself includes primary and secondary coils housed in an oil-filled transformer well, the oil being provided to keep the coils cool. Typically, studs, to which cables or conductors can be attached, protrude laterally outward from the transformer through the wall of the transformer well.

The studs are insulated from the wall of the transformer well by an insulating bushing or seal, which must be impermeable to the oil filling the transformer well. There are usually two to six studs for attaching incoming cables to the primary side, and three to four studs for attaching outgoing cables to the secondary side. Typically, there are a minimum of three studs required on the secondary side, one for each of two phases and one for a return or ground cable.

Transformers of this type may be used to deliver electric power to a relatively small number of end consumers. To supply each such consumer, one cable from each of the studs on the secondary side of the transformer is required. Typically, then, a number of cables are connected to each of the studs, one for each of the consumers being served.

Transformer connectors are used to attach the individual cables to the studs. One of the most commonly used transformer connectors is spade connector. A spade connector has a female connection end which is screwed onto a transformer stud through the screw threads on both of the stud and the spade connector. Each cable end encapsulated in a cable end lug is screwed onto the spade connector by a set of screws through one of the cable adapting ports of the spade connector.

With these traditional spade connectors, when a transformer needs to be replaced because it is no longer functioning, an electrician has to disconnect each of the cables, usually from three to thirty cables, before the spade connector can be taken off from the stud by rotating the spade connector around the stud. Moreover, each disconnected cable has to be grounded immediately for safety reasons. After the old transformer is replaced by a new transformer and the spade connectors are connected onto the studs of the new transformer, each one of the disconnected cables then has to be bolted onto the spade connector again.

Furthermore, the cable end lug closest to the stud on the spade connector are relatively difficult to access. To reach a set of bolt and nut for a cable end lug axially closest to the stud along the cable, the electrician must reach in toward the stud over a number of cables. Even worse, the inner set bolts may not be readily visible, forcing the electrician to work blindly. Moreover, as the three or four studs are often arranged one above the other on the wall of the transformer well, the electrician may often be required to reach between two layers of cables to adjust the blot of a cable attached close to a stud. Still further, bolts might have become corroded causing extreme difficulty in removing the cables.

It is apparent that this is a lengthy and labour intensive process. It usually takes from about two and half hours to about three hours to change a transformer that carries thirty electrical cables, mainly because the time required for disconnecting and connecting the cables to the spades.

Thus, an electrical wire connection strip solving the aforementioned problems is desired.

SUMMARY OF THE INVENTION

An electrical wire connection strip includes a bottom housing portion and an upper housing portion that are slidably connected to one another. The electrical wire connection strip is connectable to additional electrical wire connection strips to form a segmented electrical wire connection block or strip, where each segment can be designated to accept a certain wire gauge size.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
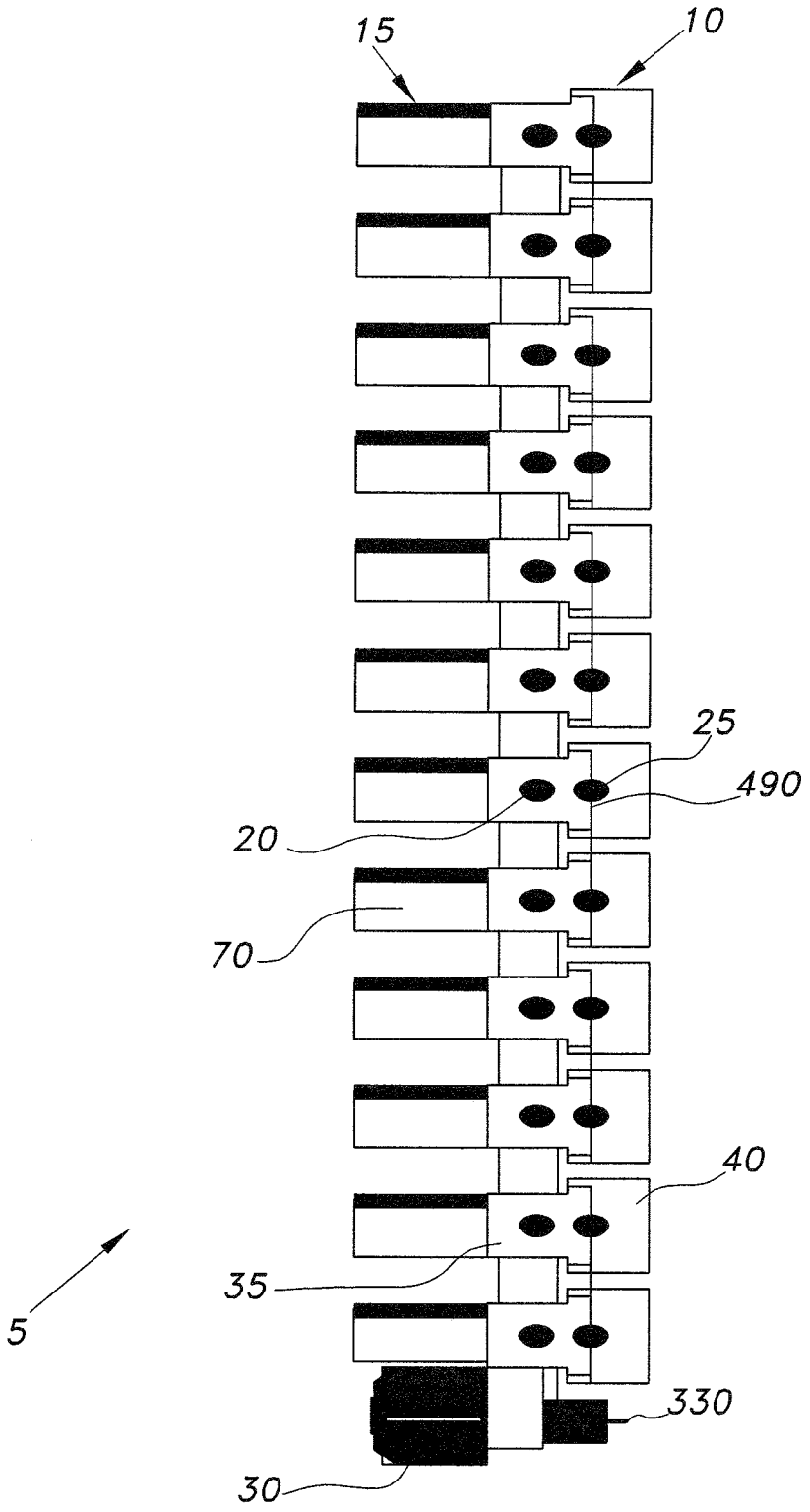
FIG. 1 shows a perspective view of the electrical wire connection strip according to the present invention.
Figure 2:
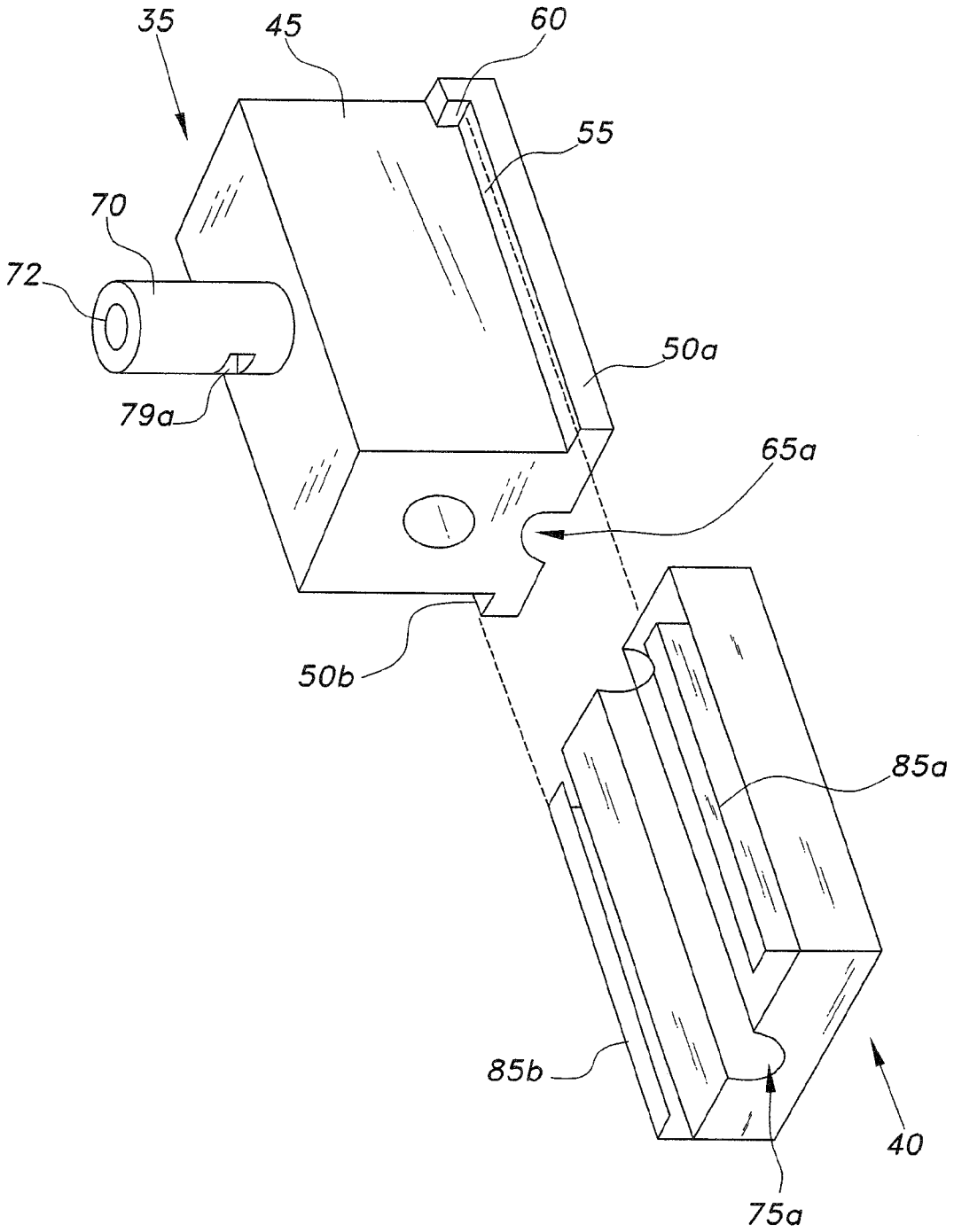
FIG. 2 shows an exploded view of an upper housing block and a lower housing block according to the present invention.
Figure 3:
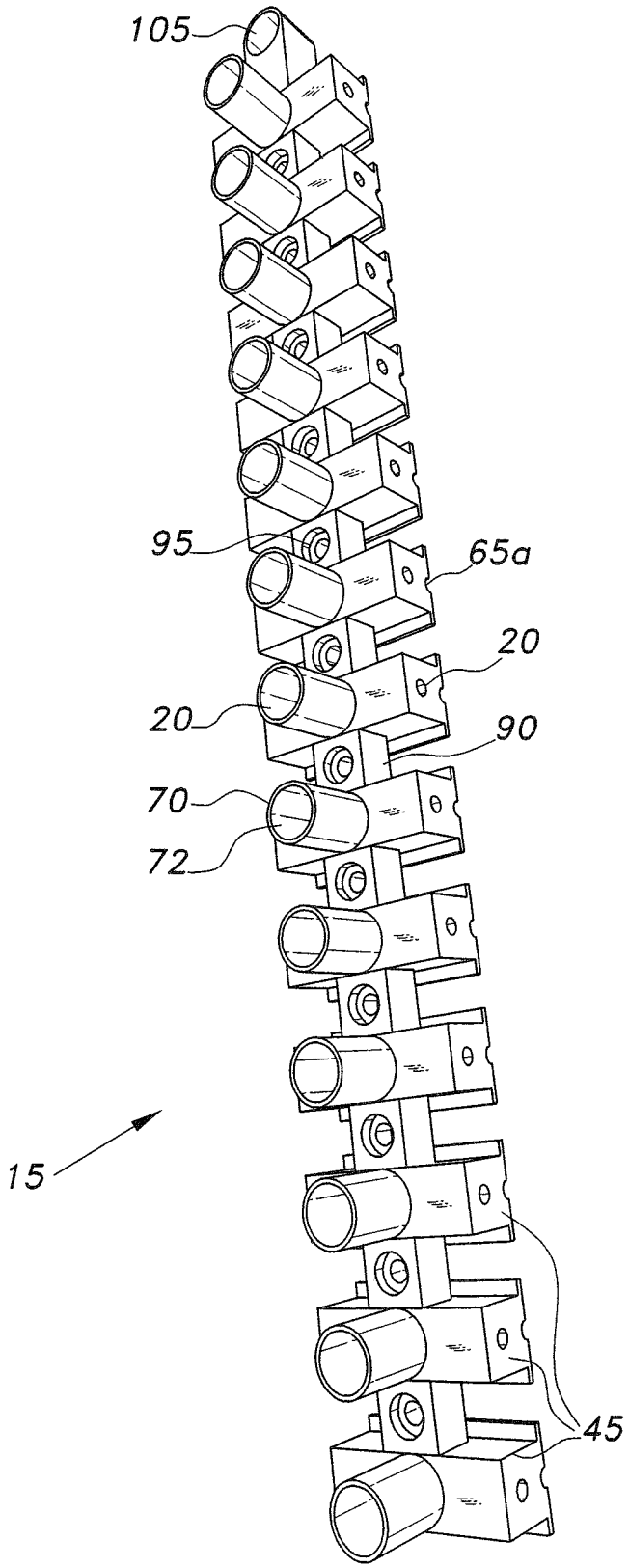
FIG. 3 shows a perspective view of an upper housing portion according to the present invention.

As shown in FIGS. 1 through 3, the electrical wire connection strip 5 includes a lower housing portion 10 and an upper housing portion 15 that slidably engages the lower housing portion 10. A fastener 30 extends through the upper housing portion 15 for fastening the strip 5 to desired electrical equipment or another electrical wire connection strip 5. The electrical wire connection strip 5 includes a plurality of first wire entry slots 20 and a plurality of second wire entry slots 25 that can be formed by infrastructure assembly aperture 490. The upper housing portion 15 includes a plurality of upper blocks 35. The lower housing portion 10 includes a plurality of lower housing blocks 40, each of which are configured to slidably engage a respective upper housing block 35, as described in detail below.

As shown in detail in FIGS. 2-3, each upper housing block 35 includes an upright base portion 45 with first and second flanges 50*a* and 50*b* extending from a lower end of opposing sides of the base portion 45. Each flange 50*a*, 50*b* includes a horizontal support surface 55 and an upright sidewall 60. A sleeve 70, having a sleeve bore 72 defined therethrough, extends, e.g., slidably, from an upper end of the base portion 45. The wire coupling bore 72 can be sized for a specific gauge of wire to prevent the user from misuse of the connector such as by, e.g., increasing the number of wires in the same slot. Sleeve opening 79*a* in sleeve 70 can align or intersect with wire entry slot 20 (shown in FIG. 3) enabling electrical connection of wire entering through the wire entry slot 20. It should be noted that sleeve bore 72 extends within sleeve 70 in a first direction, while sleeve opening 79*a* extends within sleeve 70 in a second direction that is perpendicular to the first direction.

Each lower housing block 40 includes opposing first and second arms 85*a*, 85*b*, which slidably engage first and second flanges 50*a* and 50*b* respectively. The second entry slot 25 is defined by a first groove 65*a* in the upper housing block 35 and a second groove 75*a* in the lower housing block 40. As shown more clearly in FIG. 4, the first groove 65*a* extends along a bottom surface of the base portion 45 of the upper housing block 35. A wall 65*b* is disposed within first groove 65*a*. Referring back to FIG. 2, the second groove 75*a* extends along an upper surface of the lower housing block 40. A wall 75*b* can be disposed within the second groove 75*a*. The second groove 75*a* aligns with the first groove 65*a* when the upper and lower housing blocks are engaged.

Figure 4:
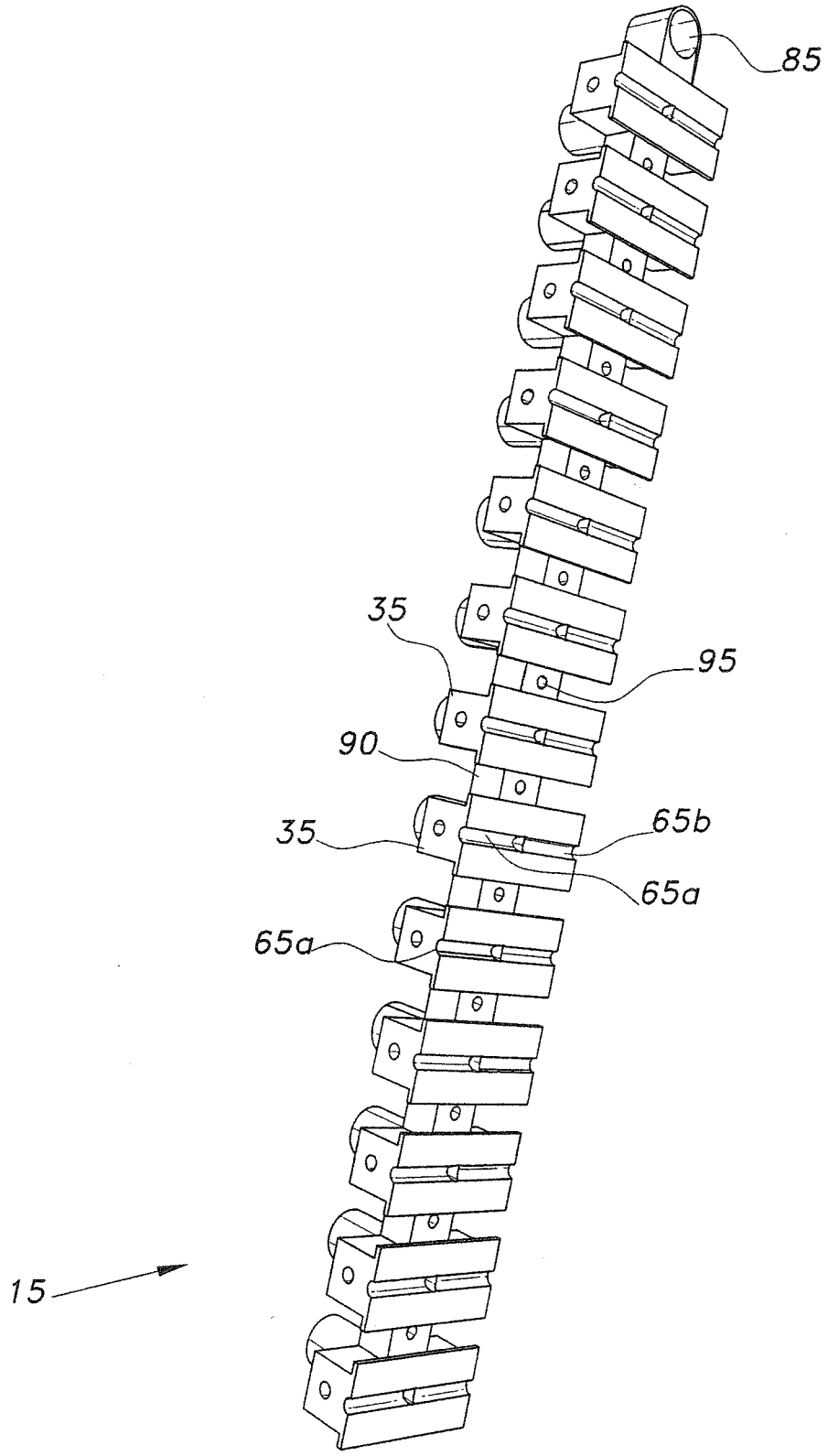
FIG. 4 shows a rear view of the upper housing portion according to the present invention.

As shown more clearly in FIG. 4, a bridge 90 connects adjacent upper housing blocks 35 of the upper housing portion 15. Each bridge 90 between adjacent upper housing blocks 35 includes an aperture 95 defined therethrough for receiving a fastener. Thus, the upper housing portion 15 can include a plurality of fasteners to further secure the lower and upper housing portions. An attachment bore 105 is defined at an end of the upper housing portion 15 for receiving the fastener 30 for fastening the strip to an adjacent connection strip or desired electrical equipment.

Figure 5:
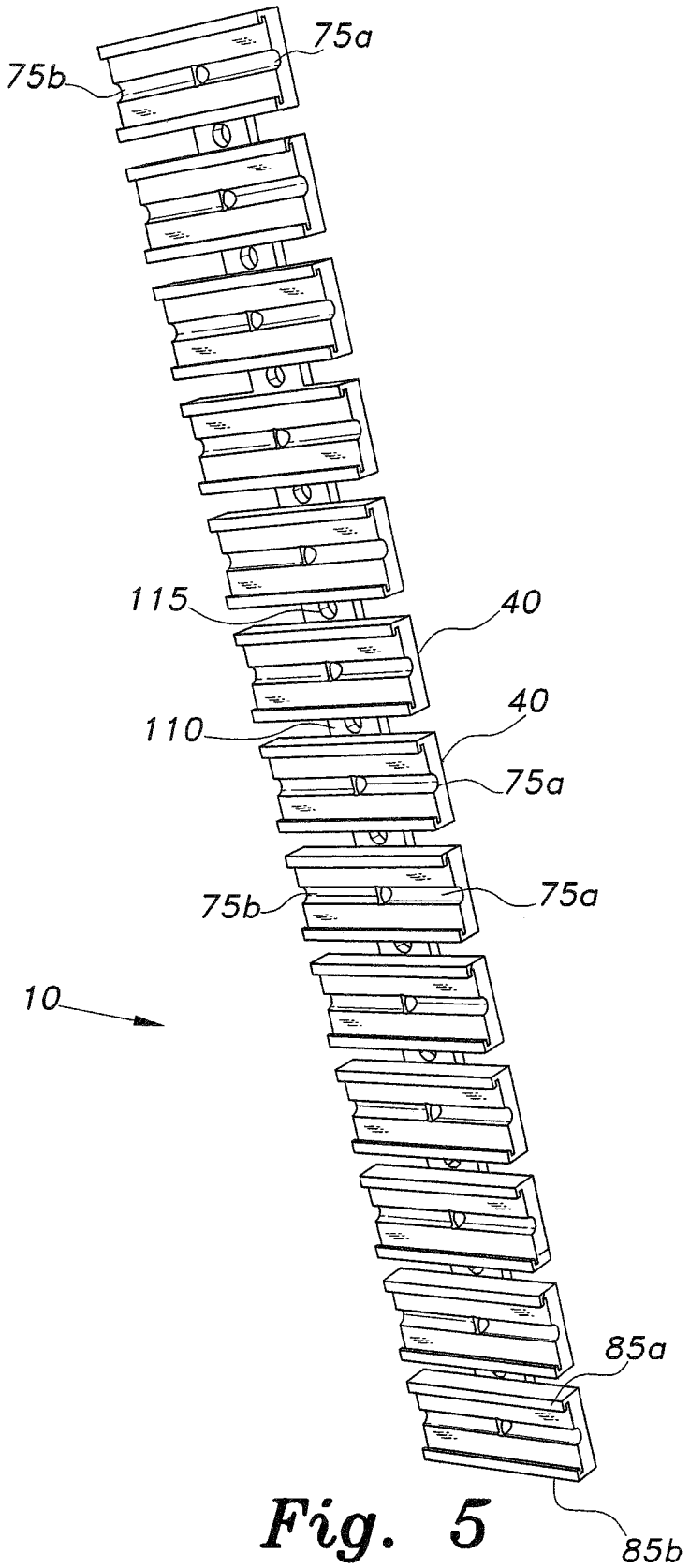
FIG. 5 shows a perspective view of the lower housing portion according to the present invention.

As shown more clearly in FIG. 5, a bridge 110 connects adjacent lower housing blocks 40 of the lower housing portion 10. Each bridge 110 between adjacent lower housing blocks 40 includes an aperture 115 defined therethrough for receiving the fastener extending through a corresponding bridge 90 of the upper housing portion 15.

Figure 6:
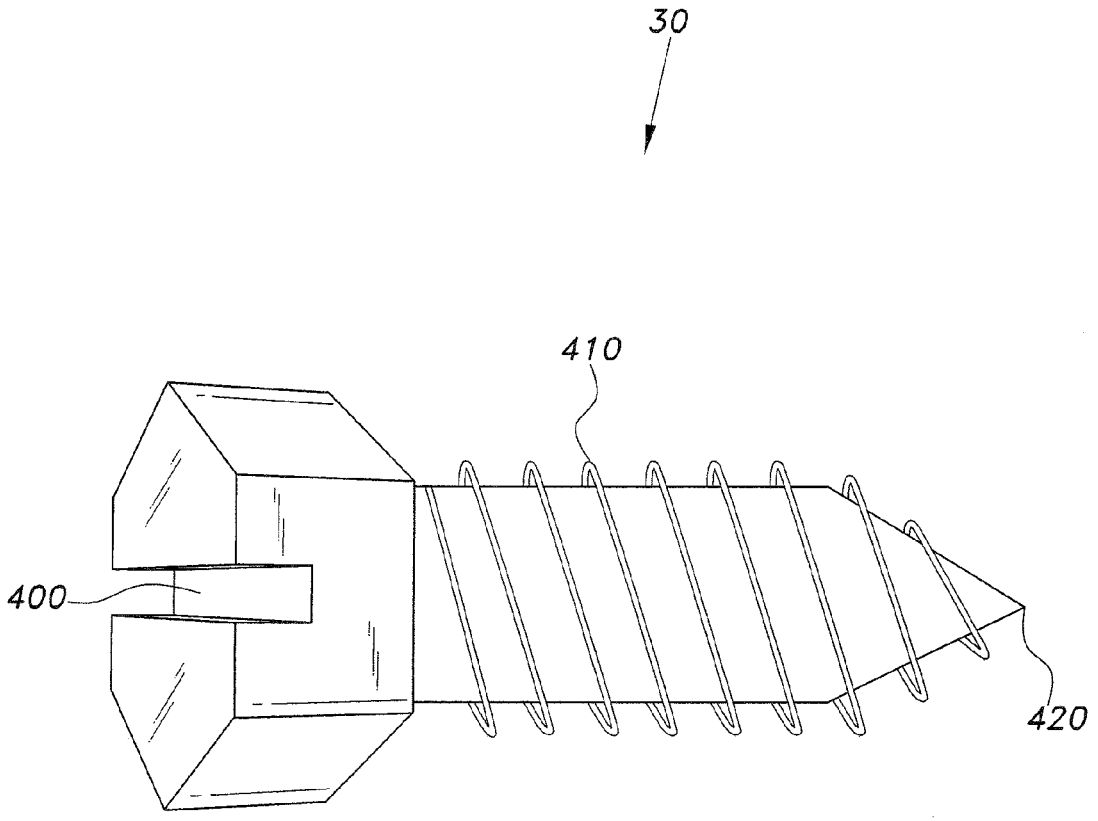
FIG. 6 shows an exploded view of an exemplary fastener according to the present invention.

The fastener 30 can be any suitable fastener. For example, the fastener 30 can be a screw, as shown in FIG. 6, including a groove 400 defined on a surface head of the screw, a threaded shaft 410, and a tip 420. Although the screw shown in FIG. 6 has a hexagonal head, the head of the screw can have a circular shape, or any other suitable shape. The hexagonal head is suitable for the sleeve bore 72 when the sleeve bore 72 is configured to have a smaller diameter, as shown in FIG. 2. The circular head is suitable for the sleeve bore 72 when the sleeve bore 72 is configured to have a larger diameter, as shown in FIG. 3. The fastener can be formed of metal and/or plastic. For example, the head can be plastic and the shaft can be metal.

Figure 7:
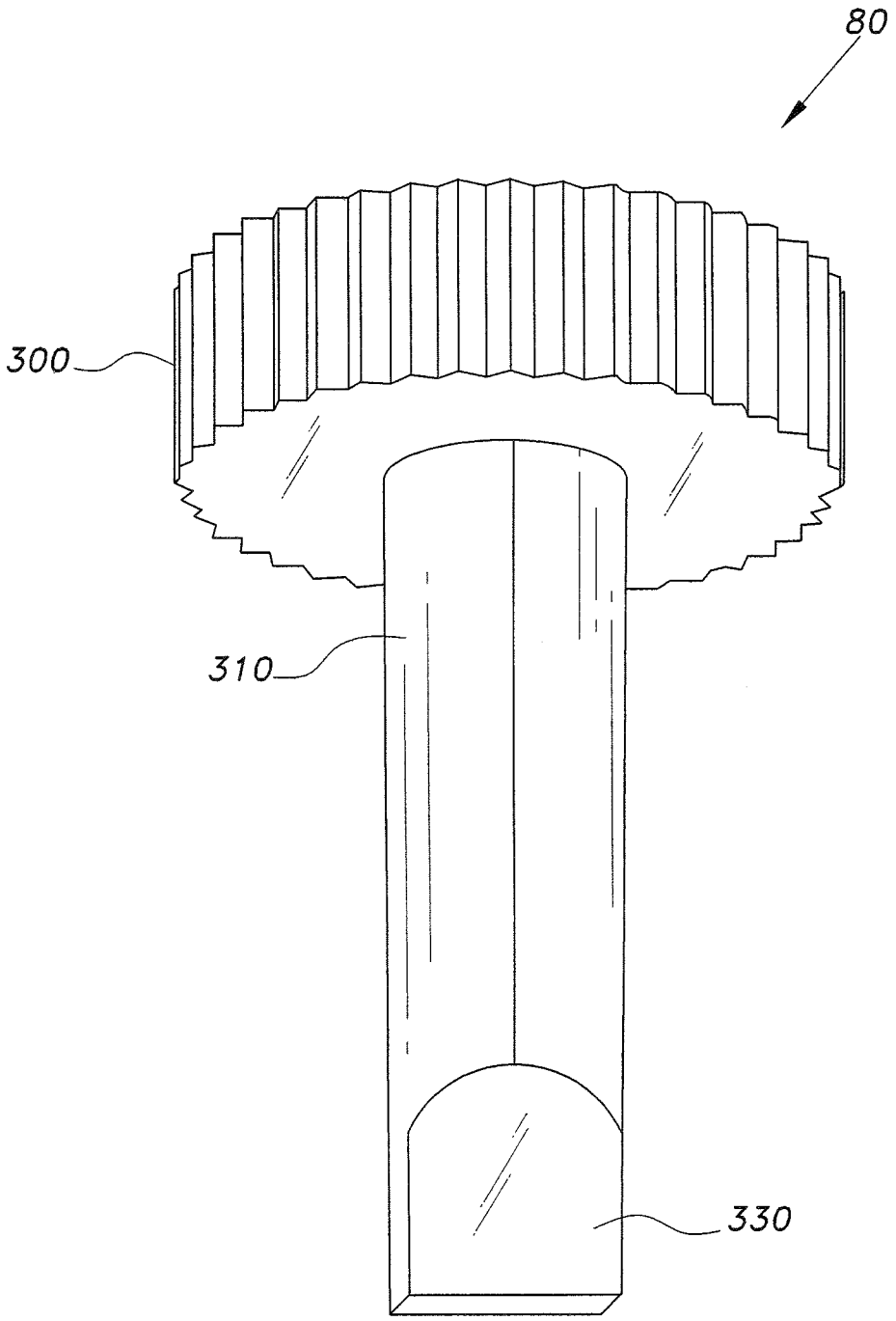
FIG. 7 shows a screw driver for fastening the fastener shown in FIG. 6.

As shown in FIG. 7, a screw driver 80 can be provided to fasten the fastener 30. The screw driver 80 can have a gear tooth fastening mechanism with a circular base 300 and a fastener shaft 310 extending from the base 300. The fastener shaft can have a tapered driver end 330. The base 300 can be formed from a plastic material. The fastener shaft 310 can be formed from metal.

Figure 8A:
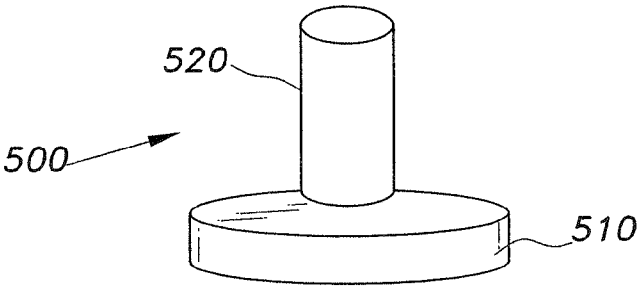
FIG. 8A shows a side view of a stopper according to the present invention.
Figure 8B:
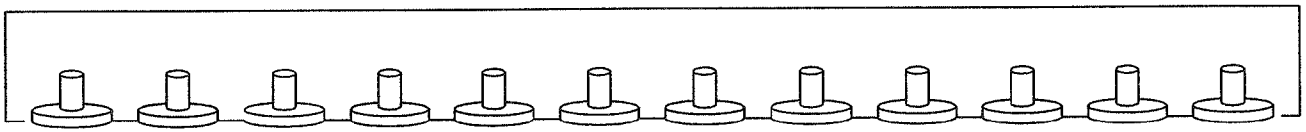
FIG. 8B shows a plurality of stoppers inserted in the wire openings according to the present invention.

A stopper 500 can be inserted into the first wire entry slots 20 and/or the second wire entry slots 25. FIG. 8A illustrates an exemplary stopper that can be used. The stopper 500 can include a stopper head 510 and a stopper shaft 520 extending from the stopper head 510. FIG. 8B illustrates the slots of the wire opening 430 adhered to each other.

It is to be understood that the present invention is not limited to the embodiments described above, but encompasses any and all embodiments within the scope of the following claims.

I claim:

1. An electrical wire connection strip, comprising:

(a) an upper housing portion, the upper housing portion including a plurality of upper housing blocks, each upper housing block including a base portion, first and second flanges extending from opposing side walls of the base portion, a sleeve extending from an upper end of the base portion, the sleeve having a sleeve bore defined therethrough, and a first entry slot in a front wall of the base portion, a bridge extending between and connecting adjacent upper housing blocks, a fastener 30 at an end of the upper housing portion, and a first groove extending along a bottom surface of the upper housing block; and (b) a lower housing portion, the lower housing portion including a plurality of lower housing blocks, each lower housing block including opposing first and second arms, the first and second arms slidably engaging the first and second flanges of the upper housing block, a bridge extending between and connecting adjacent upper housing blocks; and a second groove extending along an upper surface of the lower housing block, whereby wires disposed through the sleeves of the upper housing blocks complete electrical contact with corresponding wires disposed through the first and second entry slots when the lower housing portion and the upper housing portion are slidably engaged.

2. The electrical wire connection strip according to claim 1, wherein the sleeve includes a sleeve opening, the sleeve opening extending through the sleeve in a direction perpendicular to the sleeve bore.

3. The electrical wire connection strip according to claim 1, wherein the fastener 30 includes a gear tooth fastening mechanism.

4. The electrical wire connection strip according to claim 1, wherein the fastener 30 includes a circular base and a fastener shaft extending from the base, the fastener shaft including a tapered end.

5. The electrical wire connection strip according to claim 4, wherein the circular base includes a plastic material and the fastener shaft includes metal.

6. The electrical wire connection strip according to claim 1, further comprising a plurality of screw fasteners, each screw fastener extending through a respective bridge in the upper housing portion and a corresponding bridge in the lower housing portion, the screw fasteners securing the electrical contact between wires disposed in the sleeves and corresponding wires disposed through the first and second entry slots.

7. The electrical wire connection strip according to claim 6, wherein each screw fastener includes a hexagonal head.

* * * * *